United States Patent [19]

Urbanowicz

[11] 4,153,193

[45] May 8, 1979

[54] POLE EXTENSION FOR POWDER-ACTUATED TOOL

[75] Inventor: Edward J. Urbanowicz, Oxford, Conn.

[73] Assignee: Olin Corporation, New Haven, Conn.

[21] Appl. No.: 899,920

[22] Filed: Apr. 26, 1978

[51] Int. Cl.[2] ..... B25C 1/18

[52] U.S. Cl. ..... 227/156; 81/3 R; 294/19 R

[58] Field of Search ..... 227/10, 156; 294/19 R, 294/20, 22; 81/3 R

[56] References Cited

U.S. PATENT DOCUMENTS

| | | | |
|---|---|---|---|
| 1,258,430 | 3/1918 | Morris | 294/20 |
| 2,367,003 | 1/1945 | Carson | 294/20 |
| 3,101,212 | 8/1963 | Cater | 294/20 |

OTHER PUBLICATIONS

"This Will Fix Your Hang-Ups," Article by Ramset Fastening Systems, Branford, Conn., Advertising Brochure, copyright Aug. 1974.

*Primary Examiner*—Roy Lake
*Assistant Examiner*—Paul A. Bell
*Attorney, Agent, or Firm*—William W. Jones; Paul J. Lerner

[57] ABSTRACT

A pole extension device for use with a powder-actuated tool. A cam-equipped handle is twistably mounted on the end of a hollow elongate body. An inelastic cable is disposed within the body engaging the tool firing mechanism and attached to a pin riding on the cam, such that twisting of the handle, relative to the body, results in discharge of the tool.

5 Claims, 3 Drawing Figures

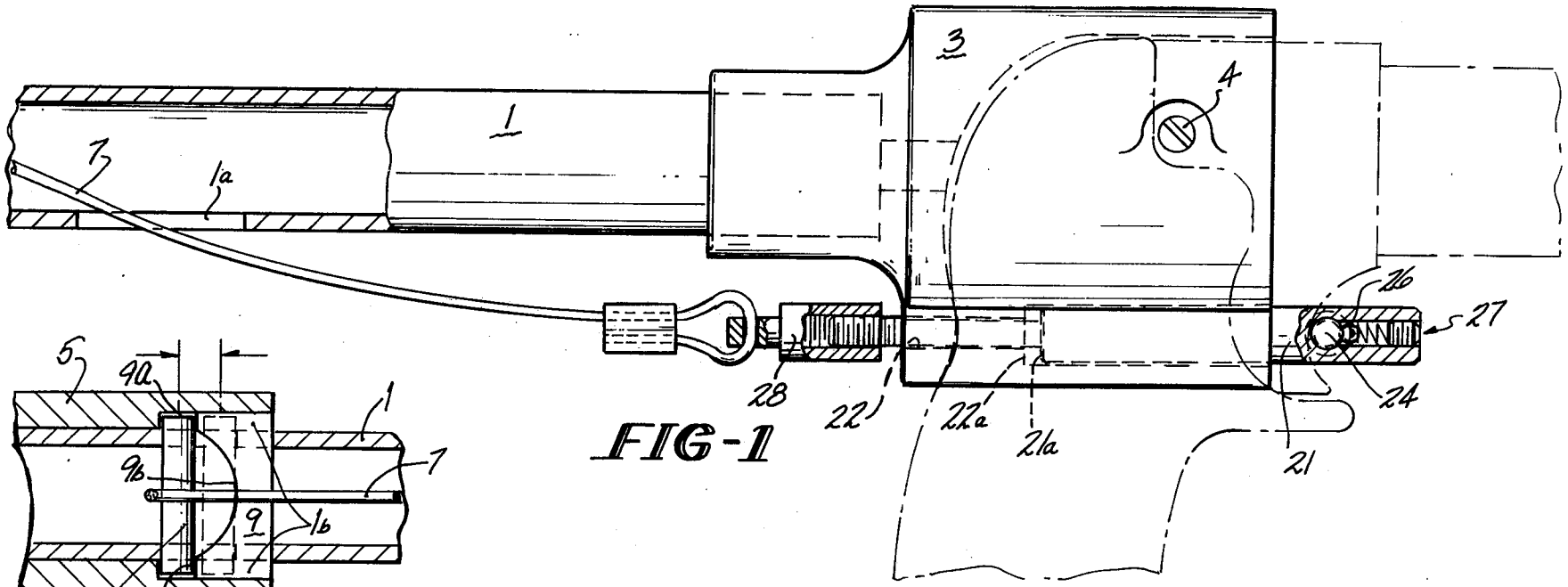
FIG-1
FIG-2
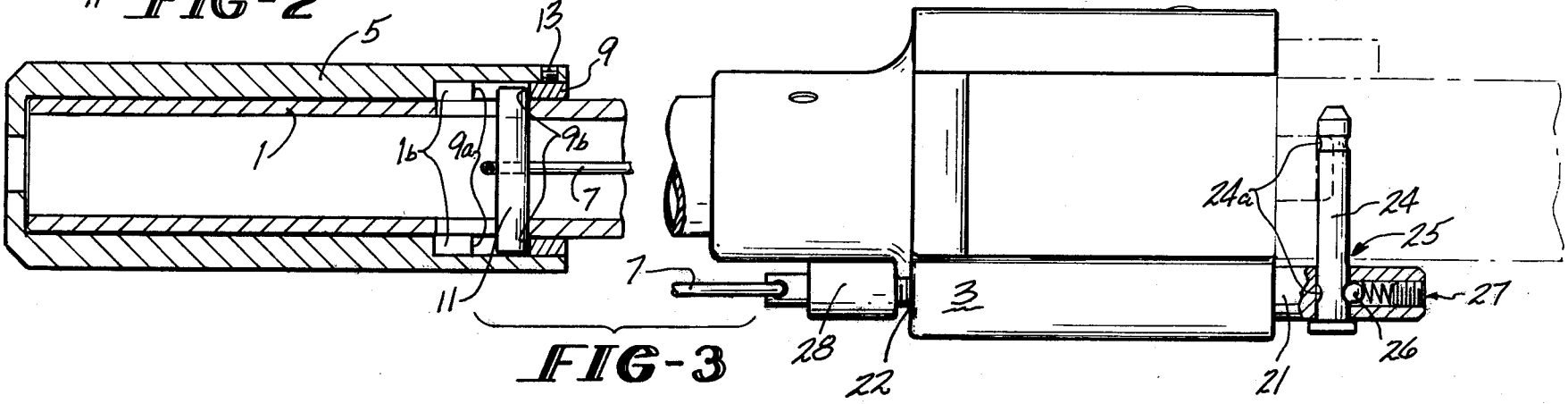
FIG-3

POLE EXTENSION FOR POWDER-ACTUATED TOOL

BACKGROUND AND SUMMARY OF THE INVENTION

The present invention relates to powder-actuated tools and, more particularly, to a pole extension device for use with such tools.

The use of extension devices, to enable the discharge of powder-actuated tools at a point remote from the user, is well known. The most common such application being in placement of fasteners in ceilings or other overhead locations beyond the unassisted reach of the tool operator. Through utilization of an extension device, the need for ladders or scaffolding may be avoided and the speed and ease of fastener installation may be increased.

The most common of the presently employed types of pole extenson devices comprises a pole, means of attaching the tool to one end of the pole, and a lanyard looped over, or otherwise engaging, the tool trigger. Such devices, although simple and effective, suffer in that the act of pulling the lanyard tends to affect the tool alignment at the moment of firing, resulting in misaligned placement of the fastener. The alignment problem is aggravated by the presence of a safety interlock (now mandatory) in the tool firing system, which requires that the tool muzzle be pressed against the workpiece while the tool is being discharged. The operator is thus required to push upward on the pole while pulling downward on the lanyard and, at the same time, maintaining proper tool alignment.

It is, therefore, an object of the present invention to provide a simple and reliable pole extension device, adapted for use with a powder-actuated tool, allowing discharge of the tool without imposition of a biasing or misaligning force thereon. This is accomplished, in general, by the provision of a twistable handle, telescopingly carried on an end of a hollow pole or body and adapted to effect discharge of the tool consequent to rotation relative thereto. More specifically, an inelastic cable, disposed within the body, is engaged at one end thereof with the tool firing mechanism and attached at the other end to a pin riding on a cam mounted for co-rotation with the handle, whereby rotation of the handle draws the cable away from the tool, discharging the same.

BRIEF DESCRIPTION OF THE DRAWING

With the above and other objects, as may hereinafter appear in mind, the present invention may be more clearly understood by reference to the following drawing, wherein:

FIG. 1 is a fragmentary, cross-sectional view of a pole extension device in accord with the present invention.

FIG. 2 is a fragmentary, cross-sectional view of the handle portion of the device of FIG. 1, showing the manner of movement of the pin.

FIG. 3 is a fragmentary view, partly in cross-section, of the bottom of the tool of FIG. 1.

DESCRIPTION OF THE PREFERRED EMBODIMENT

As seen in the drawing, the pole extension device of the present invention comprises a hollow, cylindrical body 1 having at one end thereof, a saddle-shaped gripping device 3 adapted to releasably grip a powder-actuated tool in a manner permitting discharge thereof and, telescoped over the other end, a handle 5 adapted for rotation about the longitudinal axis of the body 1.

A flexible, inelastic cable 7, disposed substantially within the body 1, is adapted for engagement with, at a first end thereof, the tool firing mechanism.

As seen in FIG. 1, the tool (shown in phantom lines) is clampingly held in the gripping device 3 by adjustable setscrews 4.

A trigger rod is slidably mounted in axial through-bore 22 in the gripping device 3, with rearward movement thereof limited by a counterbore shoulder **22*a* which cooperates with shoulder 21*a* of the rod 21. A two-position trigger bar 24, engageable with the tool trigger, is slidably carried in a transvrse through-bore 25 in the projecting end of the trigger rod 21. A spring biased ball 26 disposed in axial bore 27 cooperates with one of the annular grooves 24*a* in the trigger bar 24 to retain the same in either a trigger-engaging position, as best seen in FIG. 3**, or in a retracted, non-trigger-engaging position.

An end of the cable 7 passes through opening **1*a*, in the end of the body 1, and is adjustably attached, by screw member 28, to the projecting rearward end of the trigger rod 21, the screw member 28 serving also to prevent removal of the trigger rod 21 from the bore 22**.

The cable 7 passes through a hollow, cylindrical cam 9 co-axial with the handle 5 and adapted for co-rotation therewith, being internally affixed thereto as by means of a screw 13. A pin 11, attached to the second end of the cable 7, rides on the camming device of the cam 9. The pin 11 is slidably carried in diametrically opposed, longitudinal slots **1*b* formed in the body 1, projecting therethrough and being held captive therein by the handle 5**, whereby rotation relative thereto is prevented.

As best seen in FIG. 2, the camming surface of the cam 9 includes paired, diametrically opposed upper and lower surfaces, **9*a* and 9*b* respectively, disposed on the lower end of the cam 9, joined in a smooth continuum. Thus, as shown in the Figure, rotation of the handle 5, relative to the body 1, causes an axial displacement of the pin 11, and the cable 7 attached thereto, which is utilized to discharge the tool (shown in phantom lines in FIG. 1**).

While the preferred embodiment of the pole extension device has been specifically described, it is to be understood that other forms thereof may be made without departing from the scope of the present invention which has been described above for purposes of illustration only and is not intended to be limited by this description or otherwise except as defined by the appended claims.

I claim:

1. An extension device for use with a powder-actuated tool including a firing mechanism, said device comprising a hollow, elongate body, gripping means disposed at a first end of said body and adapted to releasably grip a powder-actuated tool in a manner permitting discharge thereof, a handle telescopingly carried on the second end of said body and adapted for rotation about the longitudinal axis thereof, a flexible, inelastic cable disposed substantially within said body and adapted for engagement, at a first end, with the tool firing mechanism, and means operably connecting said handle and the second end of said cable member whereby rotation of said handle relative to said body will result in actuation of the tool firing mechanism to discharge the tool, said means comprising a pin attached to said second end of said cable and a cam disposed within said body and adapted for co-rotation with said handle, said pin riding on said cam whereby rotation of said handle draws said pin toward said second end of said body.

2. In combination with a powder-actuated tool including a firing mechanism, a device permitting operation of the tool at a point remote from the operator, said device comprising a hollow, elongate body, attachment means at a first end of said body for releasably attaching the device to a powder-actuated tool, a twistably mounted handle telescopingly carried on the second end of said body, an inelastic cable disposed substantially within said body and adapted for engagement with the tool firing mechanism, a cam disposed within said body and adapted for corotation with said handle, and a pin attached to said cable member and riding on said cam, whereby twisting of said handle relative to said body draws said cable toward said second end of said body, discharging said tool.

3. The device of claim 1 or 2, wherein said cam is a hollow, cylindrical member, co-axial with said body, including a camming surface on the cylinder end nearer said second end of said body, and said cable passes through said cam, said pin riding on said camming surface.

4. The device of claim 1 or 2, further including track means permitting axial movement of said pin relative to said body, while preventing relative rotation therebtween.

5. The device of claim 4, wherein said track means comprises a pair of diametrically opposed slots formed in said body, said pin riding in said slots.

* * * * *